United States Patent [19]

Dougherty, Jr.

[11] 4,303,353

[45] Dec. 1, 1981

[54] POINT ATTACHMENT FOR FOUNDATION PILE

[76] Inventor: John J. Dougherty, Jr., 851 Meadow La., Franklin Lakes, N.J. 07417

[21] Appl. No.: 760,177

[22] Filed: Jan. 17, 1977

[51] Int. Cl.[3] ..... E02D 5/72

[52] U.S. Cl. ..... 405/253

[58] Field of Search ..... 61/53; 175/414, 416; 405/231, 253, 254

[56] References Cited

U.S. PATENT DOCUMENTS

| | | | |
|---|---|---|---|
| 228,467 | 6/1880 | Maclay | 61/53 |
| 1,960,888 | 5/1934 | Atwell | 61/53 |
| 3,123,978 | 3/1964 | Pruyn | 61/53 |

*Primary Examiner*—David H. Corbin

*Attorney, Agent, or Firm*—W. Patrick Quast

[57] ABSTRACT

There is disclosed an improved pile point for foundation piles such as the H-beam pile. The point provides an improved biting edge which eliminates skidding and slipping on inclined rock stratum or when the pile is used as a batter pile. The point includes a web and a pair of flanges positioned at the ends of the web and perpendicular thereto, the flanges including, typically, angled side portions to which are fixedly secured teeth-like protrusions. The latter provide a biting edge which grab hold of the supporting stratum, even when it is at a sharply inclined angle, to eliminate slipping and skidding on such surfaces.

Such teeth-like protrusions are provided on a flattened portion of the web and flange affording additional biting edges.

The latter protrusions can be arranged such that the point can provide improved biting regardless of its orientation relative to the rock stratum.

9 Claims, 11 Drawing Figures

POINT ATTACHMENT FOR FOUNDATION PILE

BACKGROUND OF THE INVENTION

This invention relates to point attachments for foundation piles and, more particularly, to pile points ideally suited for sloping rock or batter pile applications.

As stresses permitted on steel increase and design loads become heavier, it is more essential than ever that every pile reach bearing depth in dependable condition. Various types of attachments have been developed, which are affixed to the standard forms of foundation pile, e.g. an H-beam pile, and which provide necessary protection for the pile as it is driven through the layers of earth to secure bearing on solid rock. One such attachment, known in the industry as a PRUYN POINT and marketed by Associated Pile & Fitting Corp. of Clifton, N.J., is described in U.S. Pat. No. 3,123,978. This type reinforcing point has revolutionized the industry. It has proven itself time and time again, in varying soil conditions, as a superior form of reinforcement for preventing tip damage when compared to others such as the plate and angle type, with the result that the piles drive much straighter and provide greater penetration to a dependable bearing, thus achieving adequate load carrying capacity.

Typically, the angular cut (reference member II in the aforementioned patent) is selected to accommodate the anticipated rock slope based on sub-soil tests. Of course, practically speaking, such tests cannot accurately locate and characterize all the sloping rock formations which will be encountered.

Thus, if the angular cut is less acute than the angle of the ultimate bearing surface, the particular pile point selected is unable to grab a toe hold in the rock surface with the result that the point and pile are forced off the vertical and aligned with the plane of the rock surface. Eventually, the rock surface might take an inclination towards the horizontal allowing the point to grab a toe hold, but more than likely, the slope continues at the same angle necessitating "abandonment" of the damaged pile, a redesign of the "cap" for the pile arrangement and driving of new piles fitted with points having an angular cut adequate to take the necessary bite in the surface. This quite obviously is an extremely wasteful, time consuming and consequently costly procedure.

Further, it is well known in the foundation business to drive piles at varying degrees of batter—i.e. inclined to the vertical. E.g. reaction piles in bridge foundation construction. Under these driving conditions where the rock is horizontal or slopes away from the entering pile, the problem of securing a toe hold is much more difficult than if the pile was entering along the vertical.

It is therefore, a primary object of this invention to provide a reinforcement point for a pile which gives assurance of penetrating into and gripping the bearing rock surface to thereby prevent any slippage where the rock or the pile slope sharply.

It is yet another object of this invention to provide such a pile point, which will extend the versatility of known reinforcement points, giving them wider application for varying slopes of the rock bed.

SUMMARY OF THE INVENTION

Towards the accomplishment of these objects and others which will become more readily apparent from the following disclosure and the accompanying drawings, there is described an improved point for a foundation pile such as a standard H-beam pile.

The point including a web and two flanges, each of the latter perpendicular to the web and disposed at opposite ends thereof and typically having side portions angularly disposed to the horizontal, further includes teeth-like protrusions fixedly secured to the angularly disposed side portions. These teeth-like protrusions extend substantially downward from the angled side portions and they include a biting edge for grabbing and holding the rock stratum upon which the pile is to be supported.

In the preferred embodiment, the web and flanges include a coplanar flattened portions which have second tooth-like protrusions fixedly secured thereto, the latter including additional biting edges which are aligned in one embodiment. In an alternate embodiment the biting edge of these second tooth-like protrusions which are secured to the flanges are orientated at right angles to the biting edge of the protrusion on the web. This improves the flexibility of the improved point in that it provides a biting edge for orientations of the pile at 90° to the normal position.

BRIEF DESCRIPTION OF THE DRAWINGS

The present invention will be more readily understood from the following disclosure and the accompanying drawings in which.

DESCRIPTION OF THE PREFERRED EMBODIMENT

Figure 1:
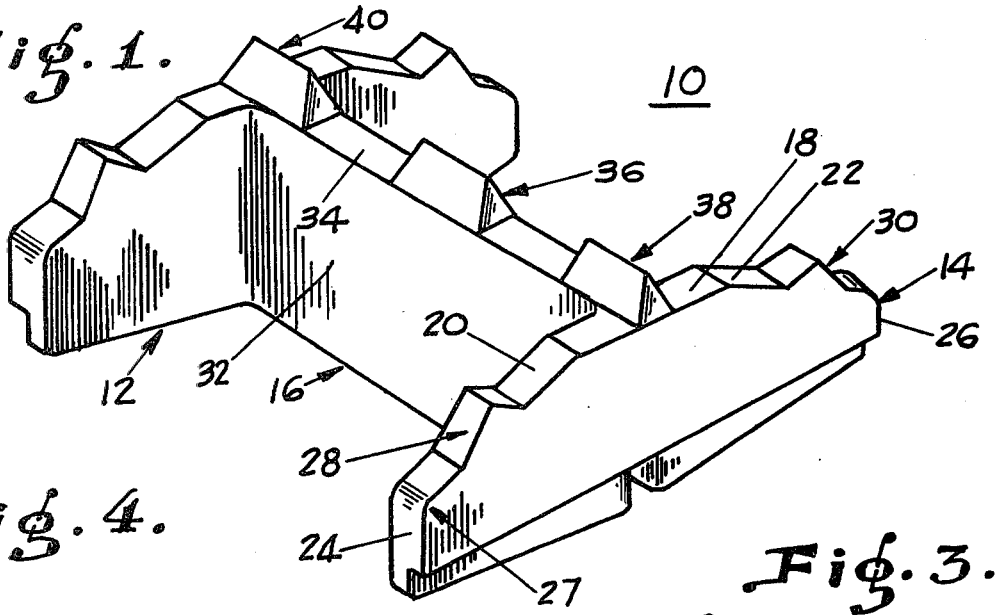
FIG. 1 is a perspective view of one embodiment of the improved driving point according to the invention.

Referring to FIG. 1, there is shown an improved driving point 10 which, for the embodiment described is to be positioned on the end of H-piles. The improved design protects the pile in driving through layers of earth and at the same time provides an improved contact surface for allowing the pile to be driven into a bearing stratum which may be inclined at relatively steep vertical angles. Preferably the point is cast steel with a typical Brinnel hardness number of 131 or greater.

The point 10 includes flanges 12 and 14 which are interconnected by a web 16 which is perpendicular to the plane of each of the flanges.

The flanges 12 and 14 are identical in configuration. For a typical point, each includes a flat bottom portion 18 and angled side portions 20 and 22 which intersect the plane of the bottom portion 18 and extend a distance downward (as viewed in FIG. 1) and away from said flat portion 18 until they strike vertically extending portions 24 and 26. (Although the embodiment described employs a point having flanges with angled side portions, the present invention has wider application to various point configurations, with and without angled sides, e.g. Associated's marketed pile point, HP75500.) The interface between the angled side portions 20 and 22 and the vertically extending side portions 24 and 26 are rounded as shown at point 27 to relieve stresses in casting. Protruding outward from the angled sides 20 and 22 are teeth-like protrusions 28 and 30.

Web 16 interconnecting flanges 12 and 14 includes a vertically extending portion 32 which bottoms in a flattened portion 34 which is coplanar with bottom portion 18. Positioned on the flattened portion 34 is a second, tent-shaped protrusion 36 and additional, similar protrusions 38 and 40 which provide a greater biting area for that line of such protrusions.

Figure 3:
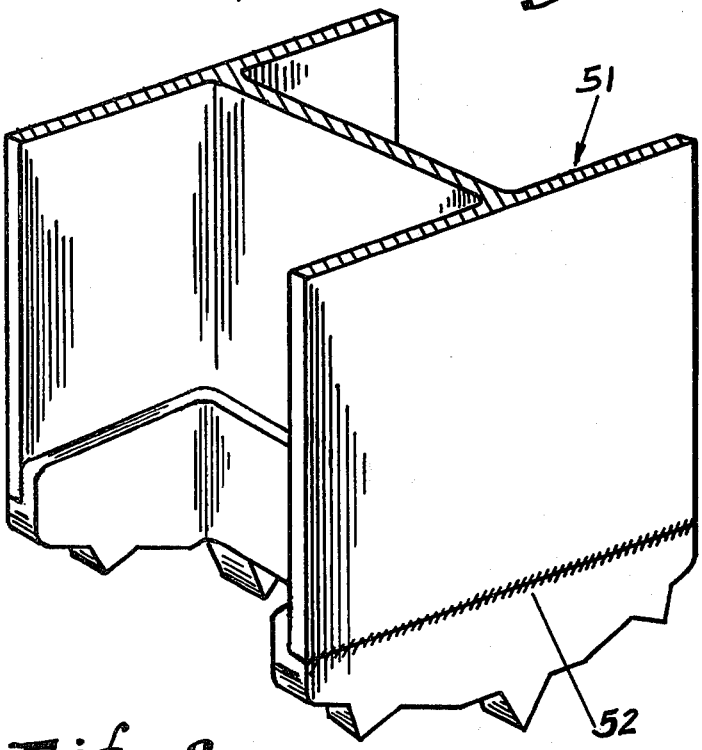
FIG. 3 is a perspective view showing an H-pile secured to an improved driving point according to this invention.
Figure 2:
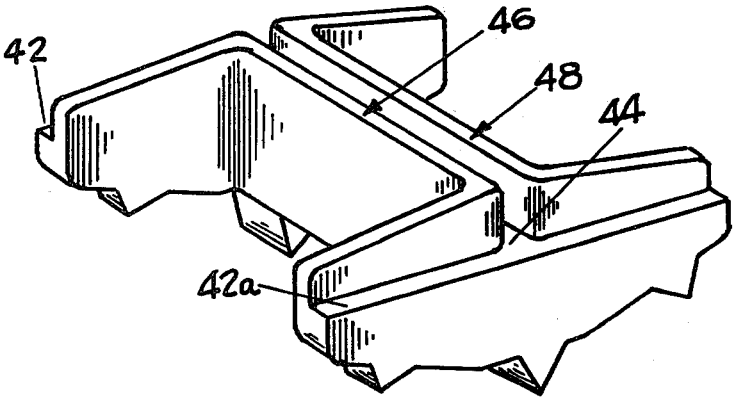
FIG. 2 is a perspective view of the upper portion of the improved driving point.

FIG. 2 shows in perspective the top portion of the improved point 10. Flanges 12 and 14 are seen to include a flattened portion 42 and 42*a* which for the preferred embodiment described are parallel to the flattened portions, such as 18, of the under sides of the flanges 12 and 14. The flattened upper surface 44, of the web 16, is coplanar with surfaces 42 and 42*a*. Vertical extending portions 46 and 48 project beyond the flattened portions 42, 42*a* and 44 to form a channel 50 positioned over the web 16 and to provide a lip over flanges 12 and 14. The H shaped outline formed is identical to the projection of the H-pile. The pile 51 rests in the channel and facilitates the joining of the point thereto. Such a connection would normally be made by an appropriate weld along the outside seam, such as 52 in FIG. 3, and its counterpart seam on the outboard side of the second flange.

Various modifications to the upper portion of the improved point 10 can be made for purposes of securing such point to the H-pile. Various alternative mounts are described in U.S. Pat. No. 3,123,978 which are likewise applicable here, as well as others which would be obvious to those skilled in the pile driving art.

Figure 4:
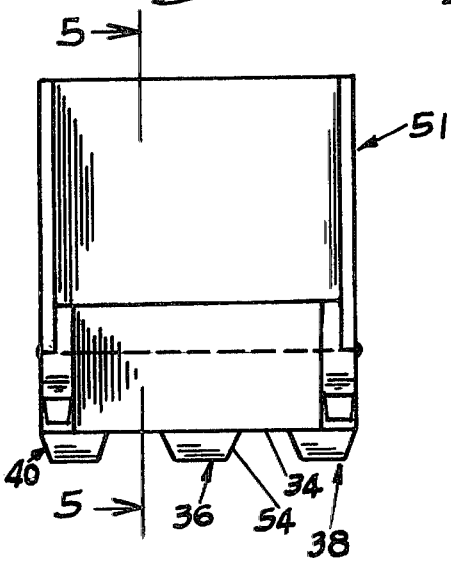
FIG. 4 is a side elevational view of the improved driving point of this invention with an H-pile in place thereon.

FIG. 4 shows a side elevational view of the pile 51, in place on the improved point. In this embodiment, protrusions 36, 38 and 40 are seen to be basically trapezoidal in profile and include sloped sides such as 54, for increased material and strength at the interface with surface 34.

Figure 5:
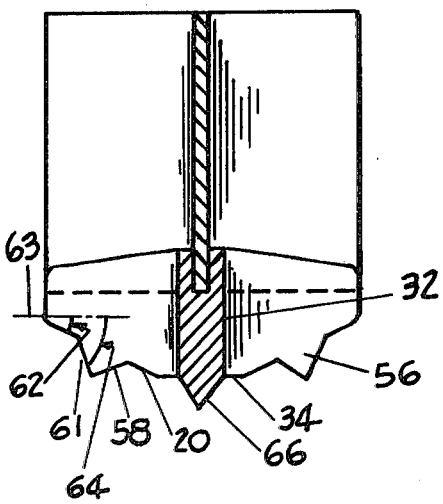
FIG. 5 is a sectional view taken along lines 5—5 of FIG. 4.
Figure 5A:
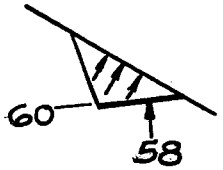
FIG. 5*a* is an expanded view of a portion of FIG. 5.

56 and 58 shown in profile view in FIG. 5 the type of teeth-like projections which have been identified as 28 and 30 in FIG. 1. Each projection is triangular in shape as viewed from the direction reflected by FIG. 5. From FIG. 5*a*, the typical protrusion 58 is seen to be shaped so as to distribute the force exerted at the tip 60 upon contact with the bearing surface, along the flange, so that a substantial portion thereof is directed towards the web. This is the stronger part of the pile and this action of the protrusion helps to reduce the destructive forces at the extremities of the flange.

Returning to FIG. 5, typically, projection 58 would include one side 61 which forms an angle 62 with imaginary line 63, representing the horizontal, which is larger than the angle 64 formed between the slope of the angled side portion such as 20 and the imaginary horizontal line.

Protrusion 66 positioned on the flat portion 34 of the web 32 is typical of the tent-shaped protrusions identified as 36 in FIG. 1. It is triangular in profile similar to protrusions 56 and 58. Being positioned immediately below the web, it inherently directs the contact forces towards it. The sides thereof strike an angle with the imaginary horizontal line which is greater than the one formed therewith by side portion 20. This provides an additional biting edge for the pile point.

Figure 6:
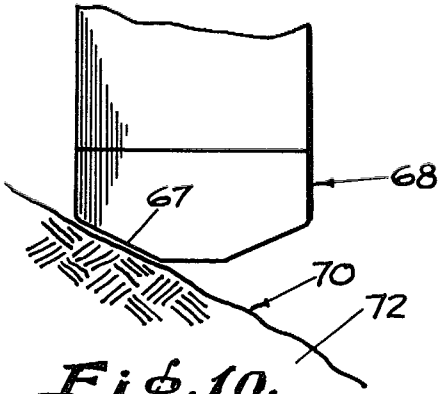
FIG. 6 is an elevational view of the prior art pile and its relationship to an inclined bearing stratum which is to provide the support for the pile.

FIG. 6 depicts an H-pile with a point such as described in the aforementioned patent affixed thereto and showing the relationship of the angled portions of that point and an inclined stratum into which it is desirable to drive the pile. The angled side 67 of the point 68 is shown to be parallel with the surface 70 of the hard stratum 72. Where this condition, i.e. parallelism between the angled side of the pile point and the surface of the stratum, exists or where the surface of the hard stratum is further inclined to the vertical, the prior art pile point has a tendency to slip or skid along the surface 70 without it penetrating the stratum as needed to provide the necessary support for the foundation.

Figure 7:
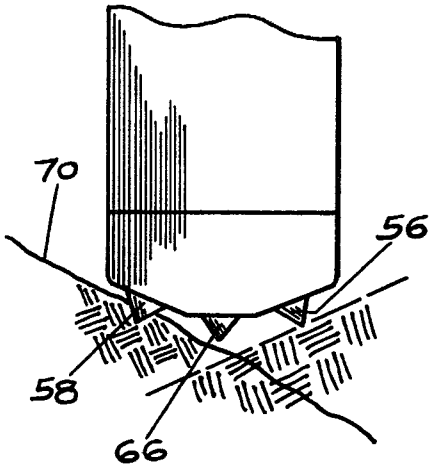
FIG. 7 is an elevational view of the improved pile in place on an H-pile showing the improved effect attributed to the design of the present invention.

FIG. 7 depicts a pile-point combination employing the improved pile point of this invention. The inclination of the surface 70 is the same as that in FIG. 6. With the improved pile point in place on the pile, it is seen how the teeth-like projection, such as 58, "bites" into the stratum providing the necessary hold, and thus avoiding the problem of skipping experienced by prior art points. Further driving of the pile-point combination into the stratum, results in the additional protrusion 66 grabbing hold of the support stratum to ensure an adequate bite into the rock, thus preventing the skidding of the pile.

In FIG. 7, there is shown in phantom, the stratum at a different inclination to the pile-point combination, i.e., the stratum is descending in the vertical in the direction opposite than that shown in FIGS. 6 and 7. From this it is apparent that the teeth-like projections such as 56, on the opposite, angled portion of the flange of the point, "bite" into the stratum initially, followed thereafter by protrusion 66. This it is seen how the improved point can be constructed so as to provide a universal type point giving the improved performance regardless of the orientation of the rock stratum.

Figure 8:
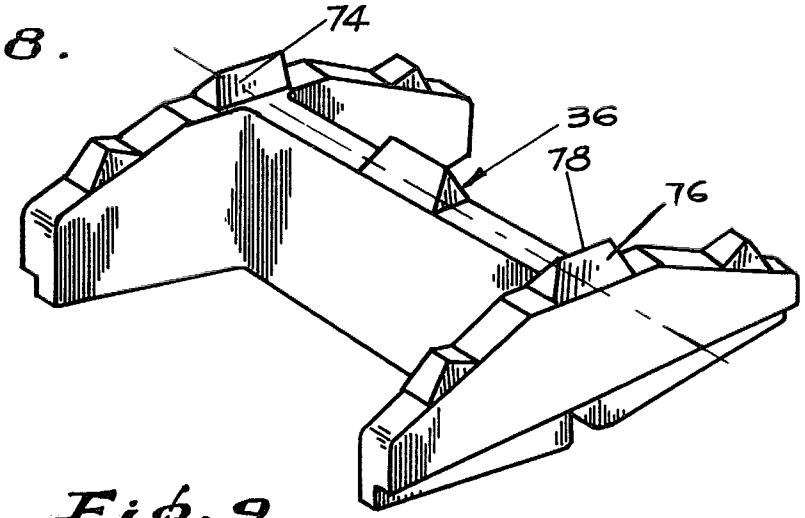
FIG. 8 is a perspective view of an alternate embodiment of the present invention.

FIG. 8 shows an alternate embodiment of the invention. In this configuration, the protrusions on the angled sides of the flanges 12 and 14 are substantially identical to those shown and described in the embodiment of FIG. 1. So likewise is the construction and disposition of the protrusion 36. However, in this alternate embodiment, the protrusions or teeth-like members positioned at the extremes of the web 16 such as 74 and 76 are now rotated 90° from the position they had in FIG. 1. Thus the biting edge provided by these protrusions, e.g. 78, is likewise perpendicular to the orientation of the edges on the similarly located protrusions shown in FIG. 1.

Figure 9:
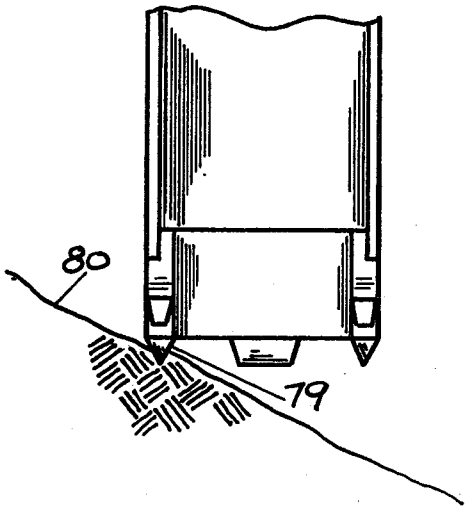
FIG. 9 is an elevational view of the embodiment of FIG. 8 in place on an H-pile, and showing the relationship of the combination to an inclined bearing stratum so as to demonstrate the improved action of the alternate form of the invention.

FIG. 9 depicts the relationship of the alternate form of the improved pile point of FIG. 8 shown in place on an H-pile and its relationship to the rock stratum 80. The figure depicts the particular orientation between rock and pile-point for which such an embodiment is more preferred. In this situation, although not apparent from the drawings, the rock stratum is actually inclined to the vertical, in a 90° spatial relationship to the rock formations of FIGS. 6 and 7. From this view it is apparent that the teeth such as 76 provide a prominent biting edge for grabbing the surface of the stratum 80 to thus avoid the slipping or skidding problem in this orientation.

While in describing the operational advantages of the improved point of this invention, it has been assumed that the pile-point combination has always been driven in the vertical and that it is inclined rock slopes that present the problem, it is to be understood that the principles of the present invention are likewise applicable to those situations where the piles are driven at an angle to the horizontal (so-called batter piles) and where in such situations, rock formations which have their interfacing surfaces almost horizontal, present similar kinds of problems as those described above.

Of course, it is to be readily understood by those skilled in the art, that modifications to the particular embodiments described are readily apparent at this point and should be considered within the scope of the present invention which is defined by the claims that follow.

E.G., while the drawings depict a single protrusion on each of the angled side portions, in fact, it is possible to have a series of protrusions along each flange. The effect achieved, for example, where the protrusions are triangular in profile, is a saw-tooth arrangement which improves the "biting" capability of the point.

Figure 10:
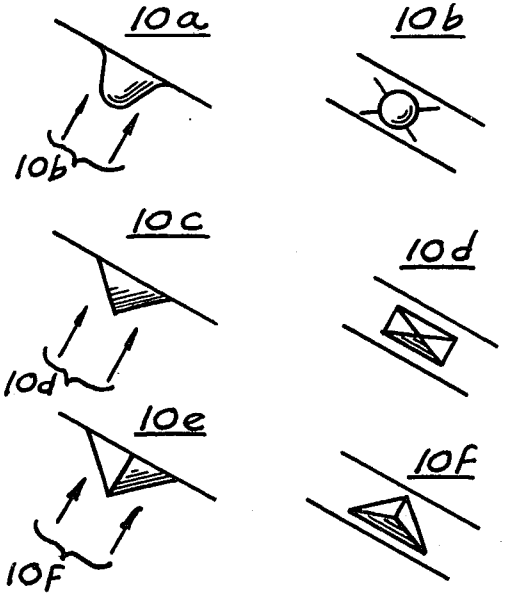
FIG. 10 is a composite, elevational and plan view showing various protrusions which can be employed to effect the purposes of the invention.

Further, although the protrusions are shown as, typically, triangular in profile, they can have the varied shapes and appearances as shown in FIG. 10 (as well as others) and still effect the purpose of the invention, which, again, is only to be bounded by the breadth of the claims which follow.

What is claimed is:

1. An improved point for a standard H-beam pile, which includes a web and two flanges, each of said flanges substantially perpendicular to said web and disposed at opposite ends of said web, said flanges each having side portions disposed in spatial relationship with the horizontal, wherein the improvement comprises at least one tooth-like protrusion fixedly secured to at least one of said side portions, said tooth-like protrusion extending substantially downward from said side portion when said pile is in a vertical position, said protrusion including a biting edge for grabbing and holding the rock stratum upon which the pile is to be supported, said protrusion shaped and disposed upon said side portion such that the forces developed upon contacting said rock stratum are distributed through said corresponding flange towards the webs of said point and H-beam pile.

2. The improved pile point of claim 1 wherein said side portions are disposed in an angular relationship with the horizontal when said point is fixedly secured to the H-pile and said pile is orientated in a vertical position.

3. The improved pile point of claim 2 further including at least one tooth-like protrusion fixedly secured to each of two of said angularly disposed side portions forming a part of one of said flanges.

4. The improved pile point of claim 3 further including at least one tooth-like protrusion fixedly secured to each of a pair of said angularly disposed side portions, each said pair forming a part of each of said flanges.

5. The improved pile point of claim 4 wherein said web and each of said flanges has a coplanar flattened portion, said angularly disposed side portions symmetrically disposed on either side of the flattened portion of said flanges, said flattened portions of said web and of said flanges lying within a plane which is disposed horizontally when the pile with said point secured thereto is positioned vertically, said point further including at least one of a second tooth-like protrusion fixedly secured to said flattened portion of at least one of said flanges.

6. The improved pile point of claim 5 further including at least one of said second tooth-like protrusions fixedly secured to said flattened portion of each of said flanges and at least one of said second tooth-like protrusions fixedly secured to said flattened portion of said web.

7. The improved pile point of claim 6 where said second tooth-like protrusions each include a biting edge, the biting edge of all of said second tooth-like protrusions colinear with the longitudinal axis of said web.

8. The improved pile point of claim 6 where said second tooth-like protrusions each include a biting edge, the biting edge of said second tooth-like protrusion fixedly secured to said flattened portion of said web colinear with the longitudinal axis of said web, the biting edge of said second tooth-like protrusions fixedly secured to said flattened portion of each of said flanges perpendicular to the longitudinal axis of said web.

9. The improved pile point of claim 1 wherein said side portions are disposed parallel to the horizontal when said point is fixedly secured to the H-pile and said pile is orientated in a vertical position.

* * * * *